US010235921B2

(12) United States Patent
Tien et al.

(10) Patent No.: US 10,235,921 B2
(45) Date of Patent: Mar. 19, 2019

(54) DISPLAY DEVICE

(71) Applicant: AU Optronics Corporation, Hsin-Chu (TW)

(72) Inventors: Kun-Cheng Tien, Hsin-Chu (TW); Chien-Huang Liao, Hsin-Chu (TW); Jia-Long Wu, Hsin-Chu (TW); Shu-En Li, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 15/461,863

(22) Filed: Mar. 17, 2017

(65) Prior Publication Data

US 2017/0278444 A1 Sep. 28, 2017

(30) Foreign Application Priority Data

Mar. 25, 2016 (TW) ..... 105109491 A

(51) Int. Cl.
*G09G 3/20* (2006.01)

(52) U.S. Cl.
CPC ..... *G09G 3/2003* (2013.01); *G09G 3/2092* (2013.01); *G09G 2300/0426* (2013.01); *G09G 2300/0443* (2013.01); *G09G 2300/0452* (2013.01); *G09G 2310/0254* (2013.01); *G09G 2310/0275* (2013.01); *G09G 2320/0209* (2013.01); *G09G 2320/0233* (2013.01)

(58) Field of Classification Search
CPC .. G09G 3/2003; G09G 3/0452; G09G 3/0426; G09G 3/0443; G09G 3/2092; G09G 2310/0254; G09G 2310/0275; G09G 2320/0209; G09G 2320/0233; G09G 2300/0452; G09G 2300/0426; G06F 3/2003; G06F 3/2092
See application file for complete search history.

(56) References Cited

U.S. PATENT DOCUMENTS 5,548,302 A 8/1996 Kuwata et al.
7,710,388 B2 5/2010 Hirata et al.
(Continued)

FOREIGN PATENT DOCUMENTS

CN 103854616 A 6/2014
CN 105047162 A 11/2015
(Continued)

OTHER PUBLICATIONS

China Patent Office "Office Action" dated May 2, 2018, China.
China Patent Office "Office Action" dated Oct. 17, 2018, China.

*Primary Examiner* — Liliana Cerullo
(74) *Attorney, Agent, or Firm* — WPAT, PC

(57) ABSTRACT

A display device includes a plurality of data lines, a plurality of scan lines, and a pixel array. The pixel array is electrically coupled to the data lines and the scan lines. Colors of the sub pixels electrically coupled to the same scan line are the same. The pixel array includes a plurality of first color sub-pixel rows, a plurality of second color sub-pixel rows, and a plurality of third color sub-pixel rows. The third color sub-pixels corresponding to the same data line include a first sub-pixel and a second sub-pixel. The first sub-pixel and the second sub-pixel have different polarities. The sub-pixels configured between the first sub-pixel and the second sub-pixel have the same polarity.

16 Claims, 8 Drawing Sheets

(56) References Cited

U.S. PATENT DOCUMENTS

| | | | | |
|---|---|---|---|---|
| 2001/0038370 | A1* | 11/2001 | Yeung | G09G 3/3614 345/87 |
| 2006/0164350 | A1* | 7/2006 | Kim | G09G 3/3614 345/87 |
| 2006/0202927 | A1* | 9/2006 | Lee | G02F 1/1368 345/88 |
| 2009/0040243 | A1* | 2/2009 | Hisada | G09G 3/3614 345/690 |
| 2011/0285950 | A1* | 11/2011 | Su | G02F 1/136286 349/139 |
| 2012/0113154 | A1* | 5/2012 | Ge | G09G 3/3614 345/690 |
| 2017/0154561 | A1 | 6/2017 | He et al. | |

FOREIGN PATENT DOCUMENTS

| | | |
|---|---|---|
| CN | 105304010 A | 2/2016 |
| JP | 2015118113 | 6/2015 |

* cited by examiner

DISPLAY DEVICE

TECHNICAL FIELD

The present disclosure relates to a display technology, and more specifically to a display device.

BACKGROUND ART

In the existing display devices, a sub-pixel area is generally divided into two areas so that a problem of side-view color washout can be improved. Different pixel voltages are applied on the two sub-pixel areas respectively to form two different brightness values, thereby improving the problem of side-view color washout.

In the above method, a voltage dividing element is used to generate at least two different pixel voltages which are respectively provided for the two sub-pixel areas. However, the aperture ratio may be affected by the presence of the voltage dividing element. Therefore, how to improve the side-view color washout problem without affecting the aperture ratio is an issue in urgent need of solutions in the art.

Special pixel configurations have been proposed to improve the above problem, but how to prevent bright and dark lines or crosstalk from affecting the display quality becomes a more important issue to be improved in the special pixel configurations.

SUMMARY OF THE INVENTION

In view of this, the present disclosure provides a display device to improve the problem described in the prior art.

One embodiment of the present disclosure relates to a display device. The display device includes a plurality of data lines, a plurality of scan lines, and a pixel array. The pixel array is electrically coupled to the data lines and the scan lines. Sub-pixels electrically coupled to the same scan line are in the same color. The pixel array includes a plurality of first color sub-pixel rows, a plurality of second color sub-pixel rows, and a plurality of third color sub-pixel rows. The first color sub-pixel rows are electrically coupled to the corresponding data lines and scan lines respectively. The second color sub-pixel rows are electrically coupled to the corresponding data lines and scan lines respectively. The third color sub-pixel rows are electrically coupled to the corresponding data lines and scan lines respectively. The third color sub-pixels corresponding to the same data line include a first sub-pixel and a second sub-pixel. The first sub-pixel and the second sub-pixel have different polarities. The sub-pixels configured between the first sub-pixel and the second sub-pixel have the same polarity.

One embodiment of the present disclosure relates to a display device. The display device includes a plurality of data lines, a plurality of scan lines, and a pixel array. The pixel array is electrically coupled to the data lines and the scan lines. The pixel array includes a plurality of first color sub-pixel columns, a plurality of second color sub-pixel columns, and a plurality of third color sub-pixel columns. The first color sub-pixel columns are electrically coupled to the corresponding data lines and scan lines respectively. The second color sub-pixel columns are electrically coupled to the corresponding data lines and scan lines respectively. The third color sub-pixel columns are electrically coupled to the corresponding data lines and scan lines respectively. The data lines on two sides of at least one of the third color sub-pixel columns have the same polarity. The data lines on two sides of the first color sub-pixel columns have different polarities. The data lines on two sides of the second color sub-pixel columns have different polarities.

In view of the above, any one of the above embodiments can be applied to reduce the impact of bright and dark lines or crosstalk on the display quality.

BRIEF DESCRIPTIONS OF THE DRAWINGS

In order to make the above and other objectives, features, advantages, and embodiments of the present disclosure more comprehensible, the accompanying drawings are described in the following:

DETAILED DESCRIPTIONS OF THE INVENTION

Figure 1:
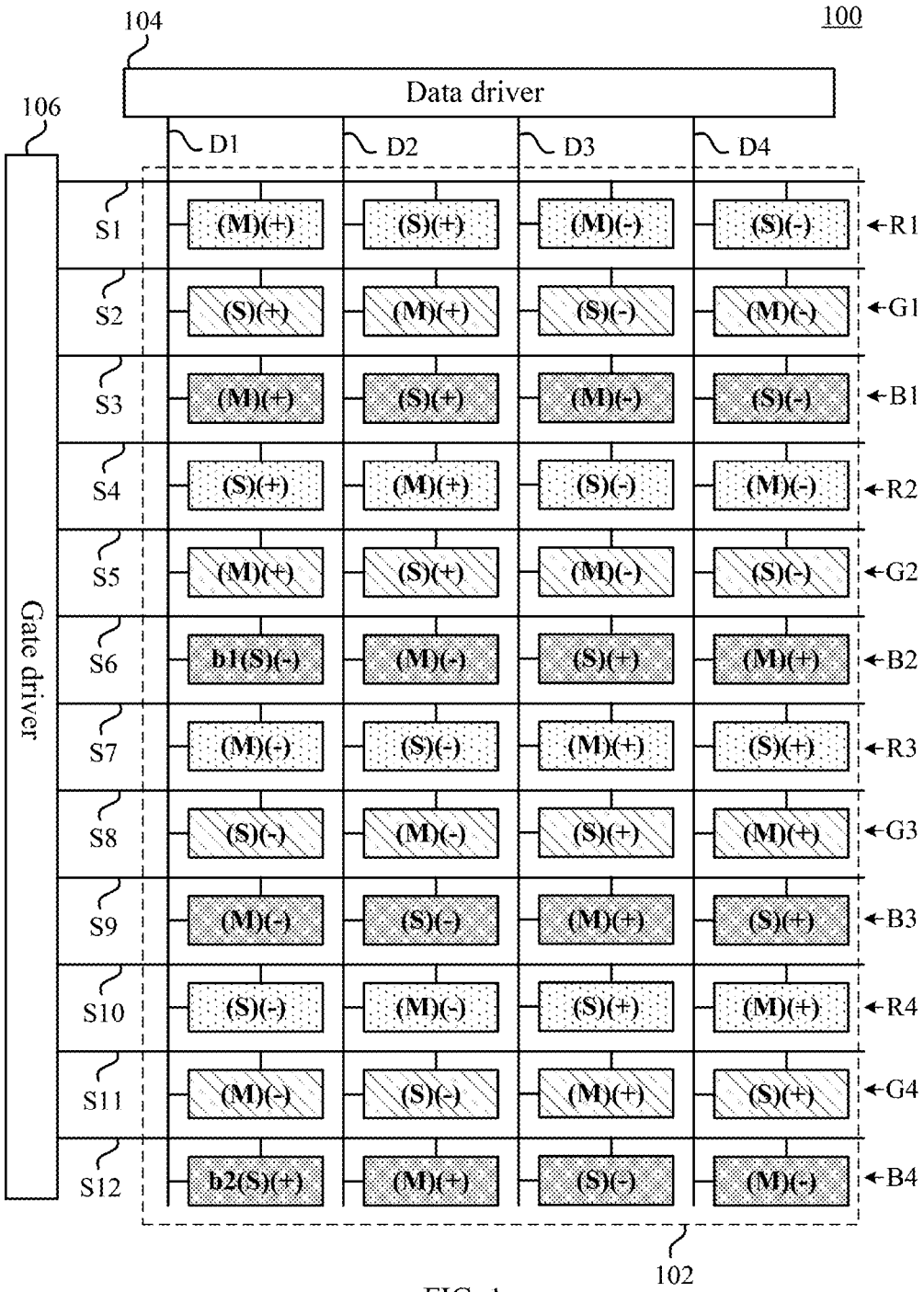
FIG. 1 is a schematic diagram of a display device according to some embodiments of the present disclosure.

Embodiments are described below in detail in combination with the accompanying drawings, but the provided embodiments are not intended to limit the scope of the present disclosure. The order in which the operations of a structure are described is not to be construed as a limitation, and any structure which is a rearrangement of the components and the resulting apparatus having an equivalent effect all fall within the scope of the present disclosure. In addition, the drawings are merely provided for illustration and have not been drawn to scale. To facilitate understanding, same or similar elements in the following description are labeled by the same reference numerals.

Terms used throughout the specification and claims, unless otherwise specified, generally possess a common meaning of each term used in the art, in the content of the present disclosure, and in a special content.

The terms "first", "second", "third" and the like used herein do not denote any particular order or sequence, are not intended to limit the present disclosure, and are used only for distinguishing between elements or operations described with the same technical terms.

FIG. 1 is a schematic diagram of a display device 100 according to some embodiments of the present disclosure. Please refer to FIG. 1. The display device 100 includes a plurality of data lines D1 to D4, a plurality of scan lines S1 to S12, and a pixel array 102.

In some embodiments, the display device 100 further includes a data driver 104 and a gate driver 106. The data driver 104 is electrically coupled to the data lines D1 to D4 to output corresponding data signals to the corresponding data lines. The gate driver 106 is electrically coupled to the scan lines S1 to S12 to output corresponding scan signals to the corresponding scan lines.

In some embodiments, the display device 100 is a tri-gate display panel. Specifically, the pixel array 102 includes a plurality of sub-pixel rows R1, R2, R3, and R4. In some embodiments, the sub-pixel rows R1, R2, R3, and R4 are first color sub-pixel rows. Each of the first color sub-pixel rows includes a plurality of first color sub-pixels. For example, each of the sub-pixel rows R1, R2, R3, and R4 includes a plurality of red sub-pixels. Please refer to FIG. 1. Each of the sub-pixel rows R1, R2, R3, and R4 includes four red sub-pixels electrically coupled to the same scan line. Specifically, the red sub-pixels of the sub-pixel row R1 are electrically coupled to the scan line S1 and are electrically coupled to the data lines D1 to D4 respectively. The red sub-pixels of the sub-pixel row R2 are electrically coupled to the scan line S4 and are electrically coupled to the data lines D1 to D4 respectively. The red sub-pixels of the sub-pixel row R3 are electrically coupled to the scan line S7 and are electrically coupled to the data lines D1 to D4 respectively. The red sub-pixels of the sub-pixel row R4 are electrically coupled to the scan line S10 and are electrically coupled to the data lines D1 to D4 respectively.

The pixel array 102 further includes a plurality of sub-pixel rows G1, G2, G3, and G4. In some embodiments, the sub-pixel rows G1, G2, G3, and G4 are second color sub-pixel rows. Each of the second color sub-pixel rows includes a plurality of second color sub-pixels. For example, each of the sub-pixel rows G1, G2, G3, and G4 includes a plurality of green sub-pixels. Please refer to FIG. 1. Each of the sub-pixel rows G1, G2, G3, and G4 includes four green sub-pixels electrically coupled to the same scan line. Specifically, the green sub-pixels of the sub-pixel row G1 are electrically coupled to the scan line S2 and are electrically coupled to the data lines D1 to D4 respectively. The green sub-pixels of the sub-pixel row G2 are electrically coupled to the scan line S5 and are electrically coupled to the data lines D1 to D4 respectively. The green sub-pixels of the sub-pixel row G3 are electrically coupled to the scan line S8 and are electrically coupled to the data lines D1 to D4 respectively. The green sub-pixels of the sub-pixel row G4 are electrically coupled to the scan line S11 and are electrically coupled to the data lines D1 to D4 respectively.

The pixel array 102 further includes a plurality of sub-pixel rows B1, B2, B3, and B4. In some embodiments, the sub-pixel rows B1, B2, B3, and B4 are third color sub-pixel rows. Each of the third color sub-pixel rows includes a plurality of third color sub-pixels. For example, each of the sub-pixel rows B1, B2, B3, and B4 includes a plurality of blue sub-pixels. Please refer to FIG. 1. Each of the sub-pixel rows B1, B2, B3, and B4 includes four blue sub-pixels electrically coupled to the same scan line. Specifically, the blue sub-pixels of the sub-pixel row B1 are electrically coupled to the scan line S3 and are electrically coupled to the data lines D1 to D4 respectively. The blue sub-pixels of the sub-pixel row B2 are electrically coupled to the scan line S6 and are electrically coupled to the data lines D1 to D4 respectively. The blue sub-pixels of the sub-pixel row B3 are electrically coupled to the scan line S9 and are electrically coupled to the data lines D1 to D4 respectively. The blue sub-pixels of the sub-pixel row B4 are electrically coupled to the scan line S12 and are electrically coupled to the data lines D1 to D4 respectively.

In brief, the pixel array 102 includes, from top to bottom, a red sub-pixel row, a green sub-pixel row, a blue sub-pixel row, a red sub-pixel row, a green sub-pixel row, and a blue sub-pixel row, and the rest can be inferred through the same manner.

As shown in FIG. 1, each of the sub-pixel rows includes a plurality of main sub-pixels and a plurality of sub sub-pixels. The main sub-pixels and the sub sub-pixels are disposed in a staggered manner. Please refer to FIG. 1. Each of the sub-pixel rows includes two main sub-pixels and two sub sub-pixels. For ease of understanding, (M) represents a main sub-pixel and (S) represents a sub sub-pixel in the figure. The sub-pixel row R1 is configured in a sequence of a main sub-pixel, a sub sub-pixel, a main sub-pixel, and a sub sub-pixel from left to right. The sub-pixel row G1 is configured in a sequence of a sub sub-pixel, a main sub-pixel, a sub sub-pixel, and a main sub-pixel from left to right. The sub-pixel row B1 is configured in a sequence of a main sub-pixel, a sub sub-pixel, a main sub-pixel, and a sub sub-pixel from left to right. In brief, the pixel array 102 is configured by main sub-pixels and sub sub-pixels in a staggered manner no matter whether it is examined from the direction of columns or rows. This pixel configuration manner can improve the problem of front-view defect.

In some embodiments, the pixel voltages applied on the main sub-pixel (M) and on the sub sub-pixel (S) are different. For example, when the display device 100 is to display a pure-color picture, such as a red, green or a blue picture, the pixel voltage on the main sub-pixel may be higher than the pixel voltage on the sub sub-pixel in the same pixel row, such that the main sub-pixel is brighter than the sub sub-pixel. The sub-pixels of two different brightness values are disposed in a staggered manner to improve the problem of side-view color washout. Compared with a conventional manner (a single sub-pixel area divided into a main sub-pixel area and a sub sub-pixel area), each of the sub-pixels in the pixel array 102 is merely used as a main sub-pixel or a sub sub-pixel. In this way, the sub-pixels in the pixel array 102 do not require the presence of an additional voltage dividing element, and the aperture ratio of the display device 100 is not affected.

In some embodiments, the main sub-pixel and the sub sub-pixel correspond to different image input sources respectively, and the resolution of the image input source is substantially equal to the resolution of the main sub-pixel plus the resolution of the sub sub-pixel.

The display device 100 in FIG. 1 adopts forward scanning. That is to say, in a frame, the scanning sequence of the display device 100 goes downward from the scan line S1, the scan line S2, and the scan line S3 to the scan line S12. Because the display device 100 adopts forward scanning, the description below for FIG. 1 is made from the top to the bottom based on the scanning direction.

In the pixel array 102, the polarities of the sub-pixels in each of the sub-pixel rows periodically change every four sub-pixels. Please refer to FIG. 1. The polarities of the sub-pixels from left to right in the sub-pixel row R1 are positive, positive, negative, and negative. The polarities of the sub-pixels from left to right in the subsequent sub-pixel row G1, sub-pixel row B1, sub-pixel row R2, and sub-pixel row G2 are also positive, positive, negative, and negative.

Polarity inversion is carried out on columns of the sub-pixel row B2. That is to say, the polarities of the sub-pixels from left to right in the sub-pixel row B2 are negative, negative, positive, and positive. The polarities of the sub-pixels from left to right in the subsequent sub-pixel row R3, sub-pixel row G3, sub-pixel row B3, sub-pixel row R4, and sub-pixel row G4 are also negative, negative, positive, and positive.

Polarity inversion is further carried out on the sub-pixel row B4. In other words, the polarities of the sub-pixels from left to right in the sub-pixel row B4 are positive, positive, negative, and negative.

In each row, the number of the main sub-pixels with the positive polarity, the number of the sub sub-pixels with the positive polarity, the number of the main sub-pixels with the negative polarity, and the number of the sub sub-pixels with the negative polarity are the same. Take the number in the sub-pixel row R1 as 1 for example. Because not all the main sub-pixels configured in the same row have the positive polarity, and not all the sub sub-pixels configured in the same row have the negative polarity, such an arrangement lowers the possibility of the H-crosstalk problem.

However, in such a configuration, the data lines on two sides of some sub-pixels have the same polarity (for example, the data lines on two sides of the sub-pixel in the upper left corner have the positive polarity). The problem of V-crosstalk is therefore likely to occur. As a result, polarity inversion needs to be carried out on the sub-pixels on the same data line (for example, the sub-pixels in the sub-pixel row B2 and the sub-pixel row B4), such that the average voltage of the pixels in the pixel array 102 in a frame may not be excessively increased or reduced and thus the possibility of having the V-crosstalk problem can be lowered.

Taking the first column of the pixel array 102 as an example. The top five sub-pixels have the positive polarity, the sixth to the eleventh sub-pixels have the negative polarity, and the twelfth sub-pixel has the positive polarity. In other words, polarity inversion is carried out on the sixth sub-pixel (the first sub-pixel b1) and the twelfth sub-pixel (the second sub-pixel b2). Please refer to FIG. 1. The first sub-pixel b1 and the second sub-pixel b2 are electrically coupled to the same data line D1 and are both blue sub-pixels. Other columns operate in a similar manner, so the details will not be repeated herein. Although the possibility of having the V-crosstalk problem may be lowered through polarity inversion, the sub-pixels located at the polarity inversion may be pre-charged to the wrong polarity and cause the dark lines at the position of polarity inversion.

However, because polarity inversion is only carried out on the sub-pixel row B2 and the sub-pixel row B4 in the pixel array 102, the dark lines will only occur in the blue sub-pixels. Human eyes are less sensitive to the blue light. When the dark lines occur in the blue sub-pixels, human eyes may not easily sense the bright and dark lines, and thus the impact of the dark lines on the viewing quality is reduced.

In another embodiment, polarity inversion is to be carried out merely on the blue sub-pixel rows in the pixel array 102, so as to reduce the impact of the dark lines on the viewing quality. Polarity inversion shown in FIG. 1 can be selectively carried out on the sub-pixel row B1, the sub-pixel row B2, the sub-pixel row B3, and the sub-pixel row B4.

Figure 2:
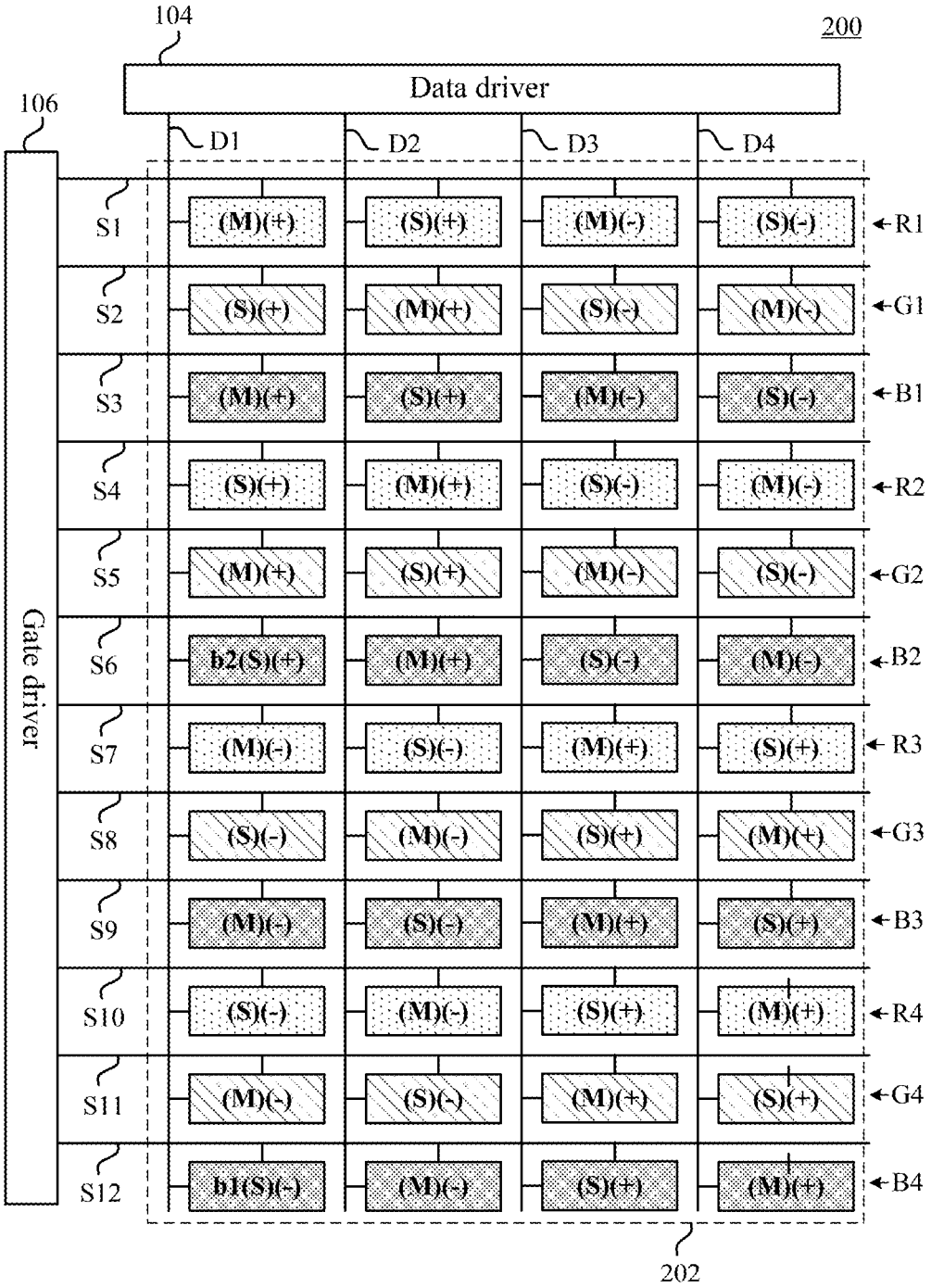
FIG. 2 is a schematic diagram of a display device according to some embodiments of the present disclosure.

FIG. 2 is a schematic diagram of a display device 200 according to some embodiments of the present disclosure. The display device 200 in FIG. 2 has a similar configuration as the display device 100 in FIG. 1. The difference between the display device 200 and the display device 100 lies in that the display device 200 adopts reverse scanning. That is to say, in a frame, the scanning sequence of the display device 200 goes upward from the scan line S12, the scan line S11, and the scan line S10 to the scan line S1. Because the display device 200 adopts reverse scanning, the description below for FIG. 2 is made from the bottom to the top based on the scanning direction.

In the pixel array 202, the polarities of the sub-pixels in each of the sub-pixel rows periodically change every four sub-pixels. Please refer to FIG. 2. The polarities of the sub-pixels from left to right in the sub-pixel row B4 are negative, negative, positive, and positive. The polarities of the sub pixels from left to right in the subsequent sub-pixel row G4, sub-pixel row R4, sub-pixel row B3, sub-pixel row G3, and sub-pixel row R3 are also negative, negative, positive, and positive.

Polarity inversion is carried out on the sub-pixel row B2. That is to say, the polarities of the sub-pixels from left to right in the sub-pixel row B2 are positive, positive, negative, and negative. The polarities of the sub-pixels from left to right in the subsequent sub-pixel row G2, sub-pixel row R2, sub-pixel row B1, sub-pixel row G1, and sub-pixel row R1 are also positive, positive, negative, and negative.

Taking the first column of the pixel array 202 as an example. The last six sub-pixels have the negative polarity, and the other sub-pixels have the positive polarity. In other words, polarity inversion is carried out on the seventh sub-pixel from the bottom (the second sub-pixel b2). Please refer to FIG. 2. The first sub-pixel b1 and the second sub-pixel b2 are electrically coupled to the same data line D1 and are both blue sub-pixels. Other columns of the pixel array 202 operate in a similar manner, so the details will not be repeated herein. Because polarity inversion is only carried out on the sub-pixel row B2 in the pixel array 202, the dark lines will only occur in the blue sub-pixels. Likewise, because human eyes are less sensitive to the blue light, the impact on the viewing quality is reduced when the dark lines occur in the blue sub-pixels.

Figure 3:
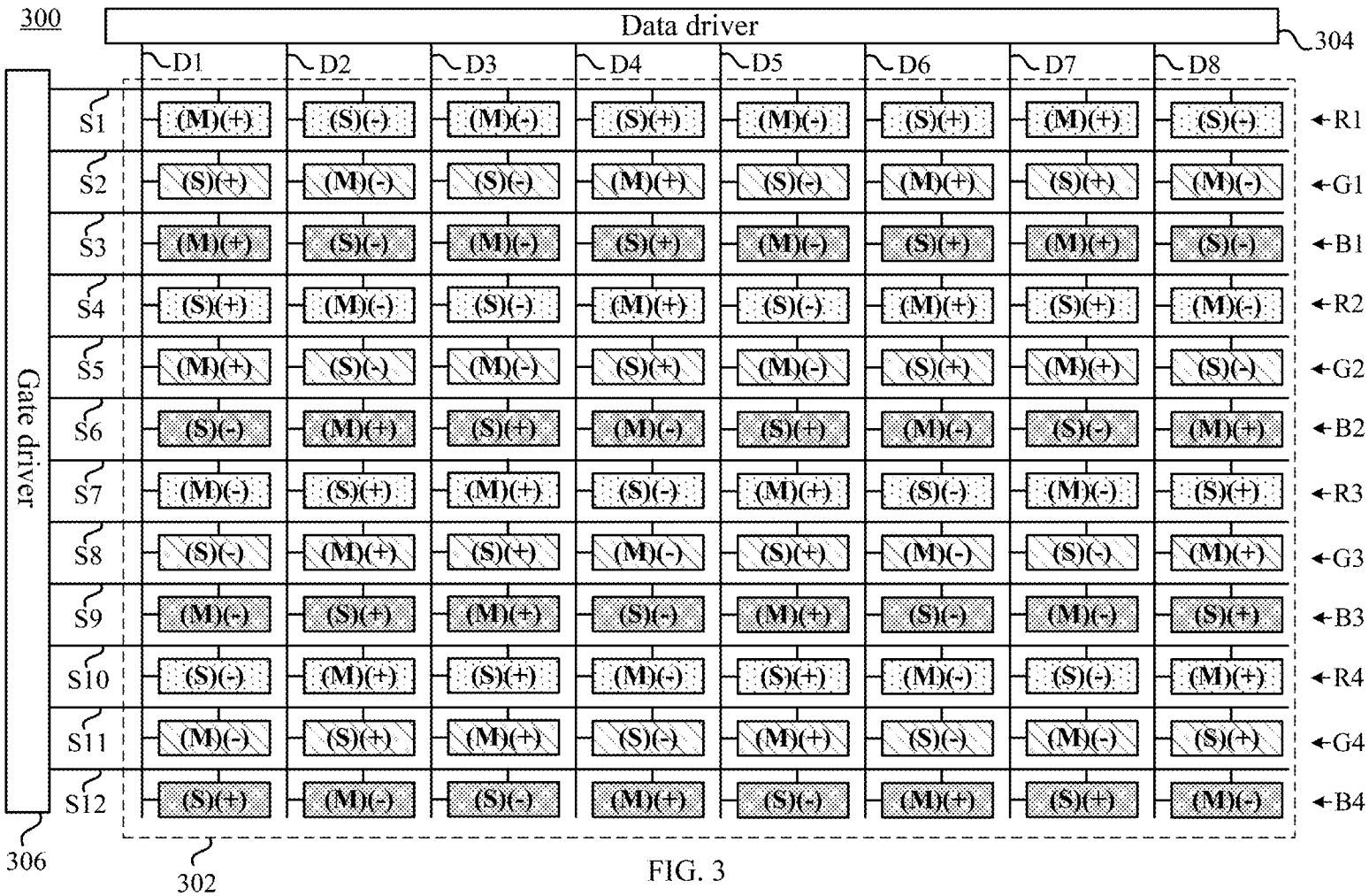
FIG. 3 is a schematic diagram of a display device according to some embodiments of the present disclosure.

FIG. 3 is a schematic diagram of a display device 300 according to some embodiments of the present disclosure. Please refer to FIG. 3. The display device 300 includes a plurality of data lines D1 to D8, a plurality of scan lines S1 to S12, and a pixel array 302.

In some embodiments, the display device 300 further includes a data driver 304 and a gate driver 306. The data driver 304 is electrically coupled to the data lines D1 to D8 to output corresponding data signals to the corresponding data lines. The gate driver 306 is electrically coupled to the scan lines S1 to S12 to output corresponding scan signals to the corresponding scan lines.

The display device 300 is a tri-gate display panel and adopts forward scanning. In the pixel array 302, the polarities of the sub-pixels in each of the sub-pixel rows periodically change every eight sub-pixels. Please refer to FIG. 3. The polarities of the sub-pixels from left to right in the sub-pixel row R1 are positive, negative, negative, positive, negative, positive, positive, and negative. The polarities of the sub-pixels from left to right in the subsequent sub-pixel row G1, sub-pixel row B1, sub-pixel row R2, and sub-pixel row G2 are also positive, negative, negative, positive, negative, positive, positive, and negative.

Polarity inversion is carried out on the sub-pixel row B2. That is to say, the polarities of the sub-pixels from left to right in the sub-pixel row B2 are negative, positive, positive, negative, positive, negative, negative, and positive. The polarities of the sub-pixels from left to right in the subsequent sub-pixel row R3, sub-pixel row G3, sub-pixel row B3, sub-pixel row R4, and sub-pixel row G4 are also negative, positive, positive, negative, positive, negative, negative, and positive.

Polarity inversion is further carried out on the sub-pixel row B4. In other words, the polarities of the sub-pixels from left to right in the sub-pixel row B4 are positive, negative, negative, positive, negative, positive, positive, and negative.

In each row of the pixel array 302, the number of the main sub-pixels in the positive polarity, the number of the sub sub-pixels in the positive polarity, the number of the main sub-pixels in the negative polarity, and the number of the sub sub-pixels in the negative polarity are the same (the number is 2); and therefore the possibility of having the H-crosstalk problem can also be lowered.

Meanwhile, the possibility of having the V-crosstalk problem may also be lowered through polarity inversion. Further, because polarity inversion is only carried out on the sub-pixel row B2 and the sub-pixel row B4 in the pixel array 302, the dark lines may only occur in the blue sub-pixels, and therefore the impact of the dark lines on the viewing quality is reduced.

Figure 4:
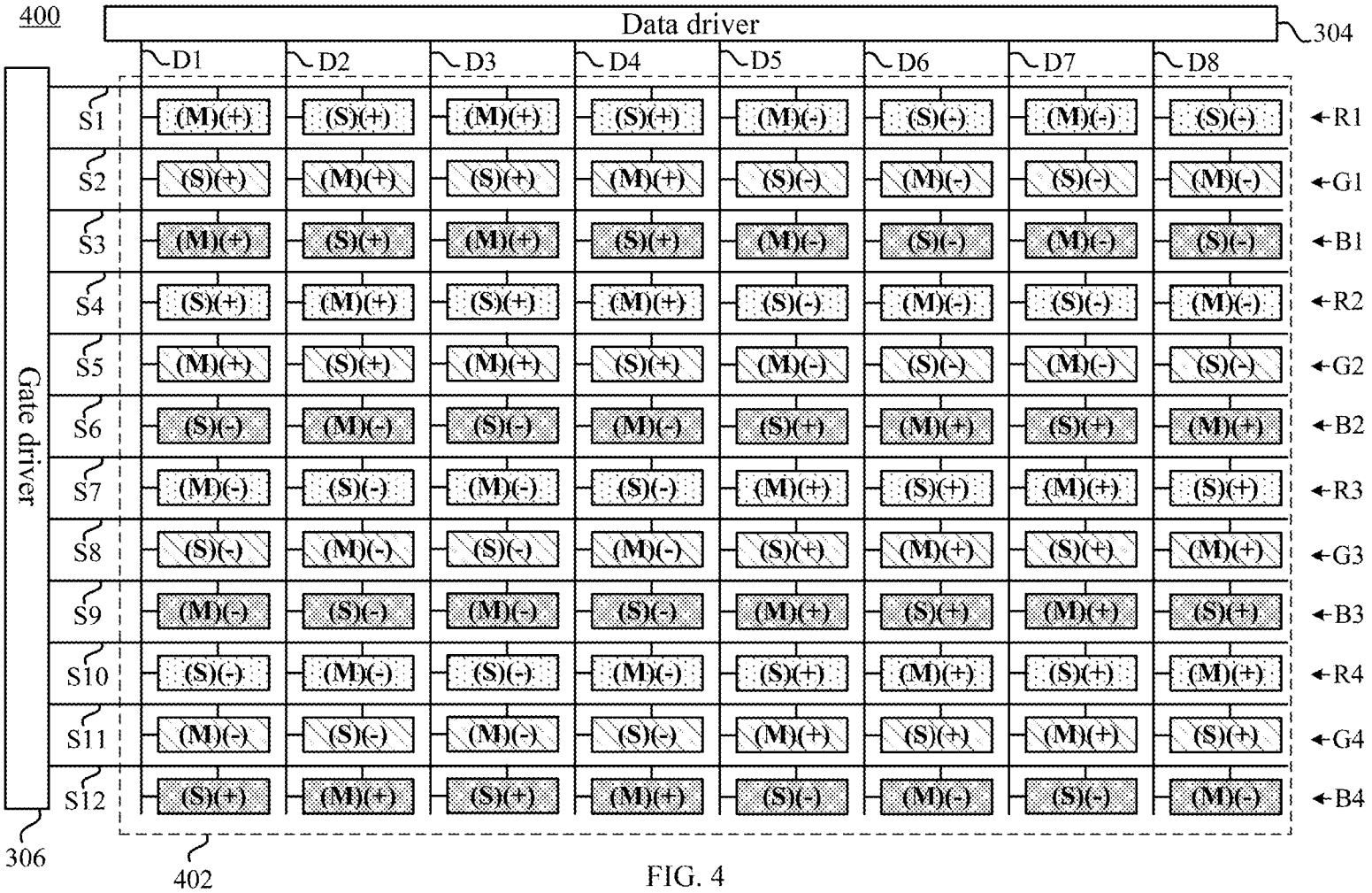
FIG. 4 is a schematic diagram of a display device according to some embodiments of the present disclosure.

FIG. 4 is a schematic diagram of a display device 400 according to some embodiments of the present disclosure. The display device 400 in FIG. 4 is similar to the display device 300 in FIG. 3. In the pixel array 402, the polarities of the sub-pixels in each of the sub-pixel rows also periodically change every eight sub-pixels. Please refer to FIG. 4. The polarities of the sub-pixels from left to right in the sub-pixel row R1 are positive, positive, positive, positive, negative, negative, negative, and negative. The polarities of the sub-pixels from left to right in the subsequent sub-pixel row G1, sub-pixel row B1, sub-pixel row R2, and sub-pixel row G2 are also positive, positive, positive, positive, negative, negative, negative, and negative.

Polarity inversion is carried out on the sub-pixel row B2. That is to say, the polarities of the sub-pixels from left to right in the sub-pixel row B2 are negative, negative, negative, negative, positive, positive, positive, and positive. The polarities of the sub-pixels from left to right in the subsequent sub-pixel row R3, sub-pixel row G3, sub-pixel row B3, sub-pixel row R4, and sub-pixel row G4 are also negative, negative, negative, negative, positive, positive, positive, and positive.

Polarity inversion is further carried out on the sub-pixel row B4. In other words, the polarities of the sub-pixels from left to right in the sub-pixel row B4 are positive, positive, positive, positive, negative, negative, negative, and negative.

In each row of the pixel array 402, the number of the main sub-pixels in the positive polarity, the number of the sub sub-pixels in the positive polarity, the number of the main sub-pixels in the negative polarity, and the number of the sub sub-pixels in the negative polarity are the same (the number is 2); and therefore the possibility of having the H-crosstalk problem can also be lowered.

Meanwhile, the possibility of having the V-crosstalk problem may also be lowered through polarity inversion. Further, because polarity inversion is only carried out on the sub-pixel row B2 and the sub-pixel row B4 in the pixel array 402, the dark lines may only occur in the blue sub-pixels, and therefore the impact of the dark lines on the viewing quality is reduced.

Figure 5:
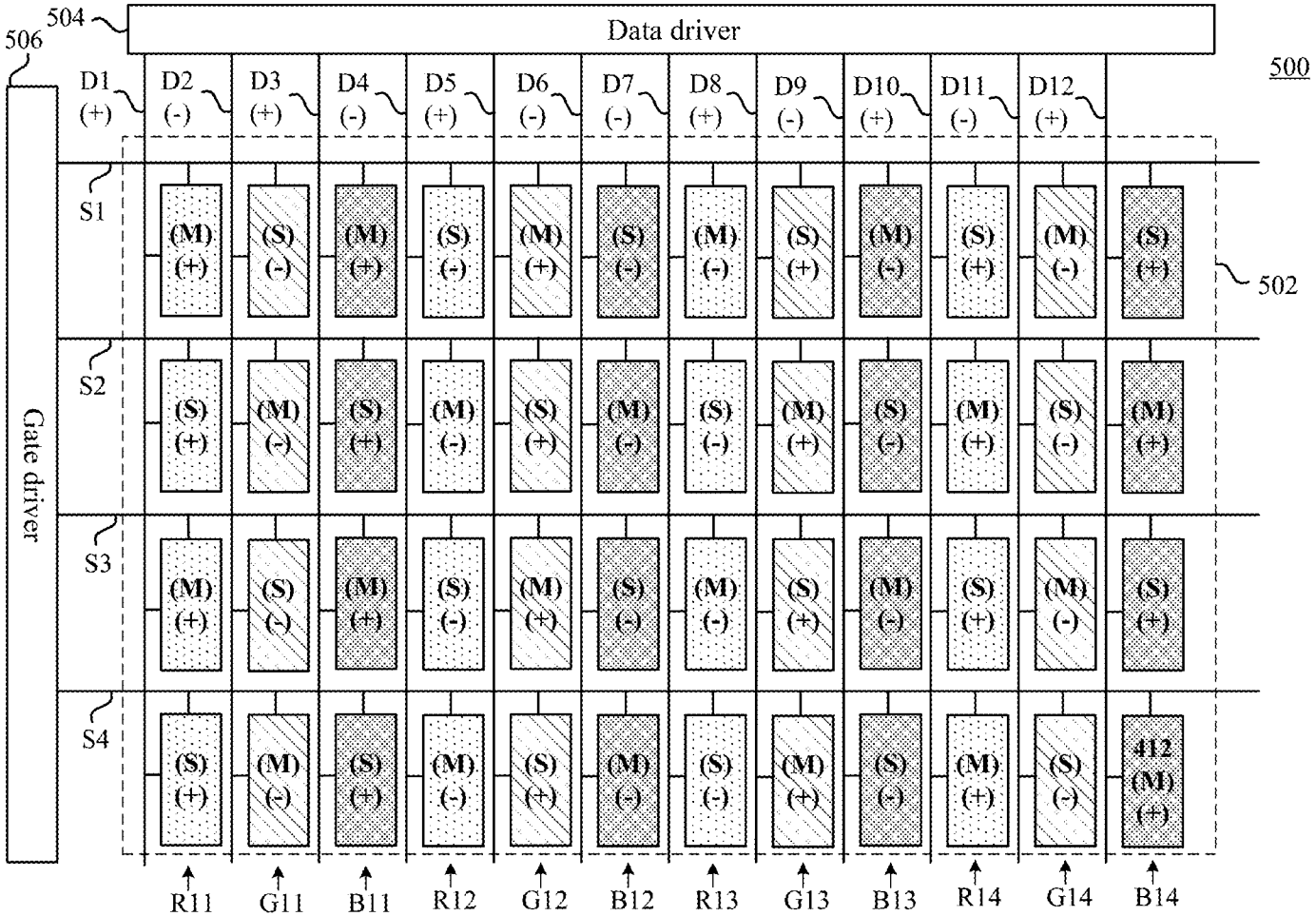
FIG. 5 is a schematic diagram of a display device according to some embodiments of the present disclosure.

FIG. 5 is a schematic diagram of a display device 500 according to some embodiments of the present disclosure. Please refer to FIG. 5. The display device 500 includes a plurality of data lines D1 to D12, a plurality of scan lines S1 to S4, and a pixel array 502.

In some embodiments, the display device 500 further includes a data driver 504 and a gate driver 506. The data driver 504 is electrically coupled to the data lines D1 to D12 to output corresponding data signals to the corresponding data lines. The gate driver 506 is electrically coupled to the scan lines S1 to S4 to output corresponding scan signals to the corresponding scan lines.

The pixel array 502 includes a plurality of sub-pixel columns R11, R12, R13, and R14. In some embodiments, the sub-pixel columns R11, R12, R13, and R14 are first color sub-pixel columns. Each of the sub-pixel columns includes a plurality of first color sub-pixels. For example, each of the sub-pixel columns R11, R12, R13, and R14 includes a plurality of red sub-pixels. Please refer to FIG. 5. Each of the sub-pixel columns R11, R12, R13, and R14 includes four red sub-pixels electrically coupled to the same data line. Specifically, the red sub-pixels of the sub-pixel column R11 are electrically coupled to the data line D1 and are electrically coupled to the scan lines S1 to S4 respectively. The red sub-pixels of the sub-pixel column R12 are electrically coupled to the data line D4 and are electrically coupled to the scan lines S1 to S4 respectively. The red sub-pixels of the sub-pixel column R13 are electrically coupled to the data line D7 and are electrically coupled to the scan lines S1 to S4 respectively. The red sub-pixels of the sub-pixel column R14 are electrically coupled to the data line D10 and are electrically coupled to the scan lines S1 to S4 respectively.

The pixel array 502 further includes a plurality of sub-pixel columns G11, G12, G13, and G14. In some embodiments, the sub-pixel columns G11, G12, G13, and G14 are second color sub-pixel columns. Each of the sub-pixel columns includes a plurality of second color sub-pixels. For example, each of the sub-pixel columns G11, G12, G13, and G14 includes a plurality of green sub-pixels. Please refer to FIG. 5. Each of the sub-pixel columns G11, G12, G13, and G14 includes four green sub-pixels electrically coupled to the same data line. Specifically, the green sub-pixels of the sub-pixel column G11 are electrically coupled to the data line D2 and are electrically coupled to the scan lines S1 to S4 respectively. The green sub-pixels of the sub-pixel column G12 are electrically coupled to the data line D5 and are electrically coupled to the scan lines S1 to S4 respectively. The green sub-pixels of the sub-pixel column G13 are electrically coupled to the data line D8 and are electrically coupled to the scan lines S1 to S4 respectively. The green sub-pixels of the sub-pixel column G14 are electrically coupled to the data line D11 and are electrically coupled to the scan lines S1 to S4 respectively.

The pixel array 502 further includes a plurality of sub-pixel columns B11, B12, B13, and B14. In some embodiments, the sub-pixel columns B11, B12, B13, and B14 are third color sub-pixel columns. Each of the sub-pixel columns includes a plurality of third color sub-pixels. For example, each of the sub-pixel columns B11, B12, B13, and B14 includes a plurality of blue sub-pixels. Please refer to FIG. 5. Each of the sub-pixel columns B11, B12, B13, and B14 includes four blue sub-pixels electrically coupled to the same data line. Specifically, the blue sub-pixels of the sub-pixel column B11 are electrically coupled to the data line D3 and are electrically coupled to the scan lines S1 to S4 respectively. The blue sub-pixels of the sub-pixel column B12 are electrically coupled to the data line D6 and are electrically coupled to the scan lines S1 to S4 respectively. The blue sub-pixels of the sub-pixel column B13 are electrically coupled to the data line D9 and are electrically coupled to the scan lines S1 to S4 respectively. The blue sub-pixels of the sub-pixel column B14 are electrically coupled to the data line D12 and are electrically coupled to the scan lines S1 to S4 respectively.

In brief, the pixel array 502 includes, from left to right, a red sub-pixel column, a green sub-pixel column, a blue sub-pixel column, a red sub-pixel column, a green sub-pixel column, a blue sub-pixel column, and the rest can be inferred through the same manner.

As shown in FIG. 5, each of the sub-pixel columns includes a plurality of main sub-pixels (M) and a plurality of sub sub-pixel (S). The main sub-pixels and the sub sub-pixels are disposed in a staggered manner. Please refer to FIG. 5. Each of the sub-pixel columns includes two main sub-pixels and two sub sub-pixels. The sub-pixel column R11 is configured in a sequence of a main sub-pixel, a sub sub-pixel, a main sub-pixel, and a sub sub-pixel from top to bottom. The sub-pixel column G11 is configured in a sequence of a sub sub-pixel, a main sub-pixel, a sub sub-pixel and, a main sub-pixel from top to bottom. The sub-pixel column B11 is configured in a sequence of a main sub-pixel, a sub sub-pixel, a main sub-pixel, and a sub sub-pixel from top to bottom. In brief, the pixel array 502 is configured by main sub-pixels and sub sub-pixels in a staggered manner no matter whether it is examined from the direction of columns or rows.

In the pixel array 502, the polarities of the data lines periodically change every twelve data lines. Please refer to FIG. 5. The polarities of the data lines D1 to D12 from left to right are positive, negative, positive, negative, positive, negative, negative, positive, negative, positive, negative, and positive. The pixel array 502 adopts column inversion. That is to say, the sub-pixels electrically coupled to the same data line have the same polarity.

In the configuration of the pixel array 502, the data lines on two sides of any one of the sub-pixel columns R11, R12, R13, and R14 have different polarities. The data lines on two sides of any one of the sub-pixel columns G11, G12, G13, and G14 have different polarities. The data lines on two sides of any one of the sub-pixel columns B11 and B13 have different polarities.

However, the data lines D6 and D7 on two sides of the sub-pixel column B12 (the blue sub-pixel column) have the same polarity (for example, they both have the negative polarity). The data lines D12 and D13 on two sides of the sub-pixel column B14 (the blue sub-pixel column) have the same polarity (for example, they both have the positive polarity).

Column inversion is carried out on the pixel array 502, and the problem of pre-charging to the wrong polarity (resulting in bright and dark lines) due to polarity inversion may not happen. Because only the data lines on two sides of the blue sub-pixel column have the same polarity, the V-crosstalk problem may only occur in the blue sub-pixels. However, human eyes are less sensitive to the blue light and thus may not easily sense the impact of the crosstalk.

Figure 6:
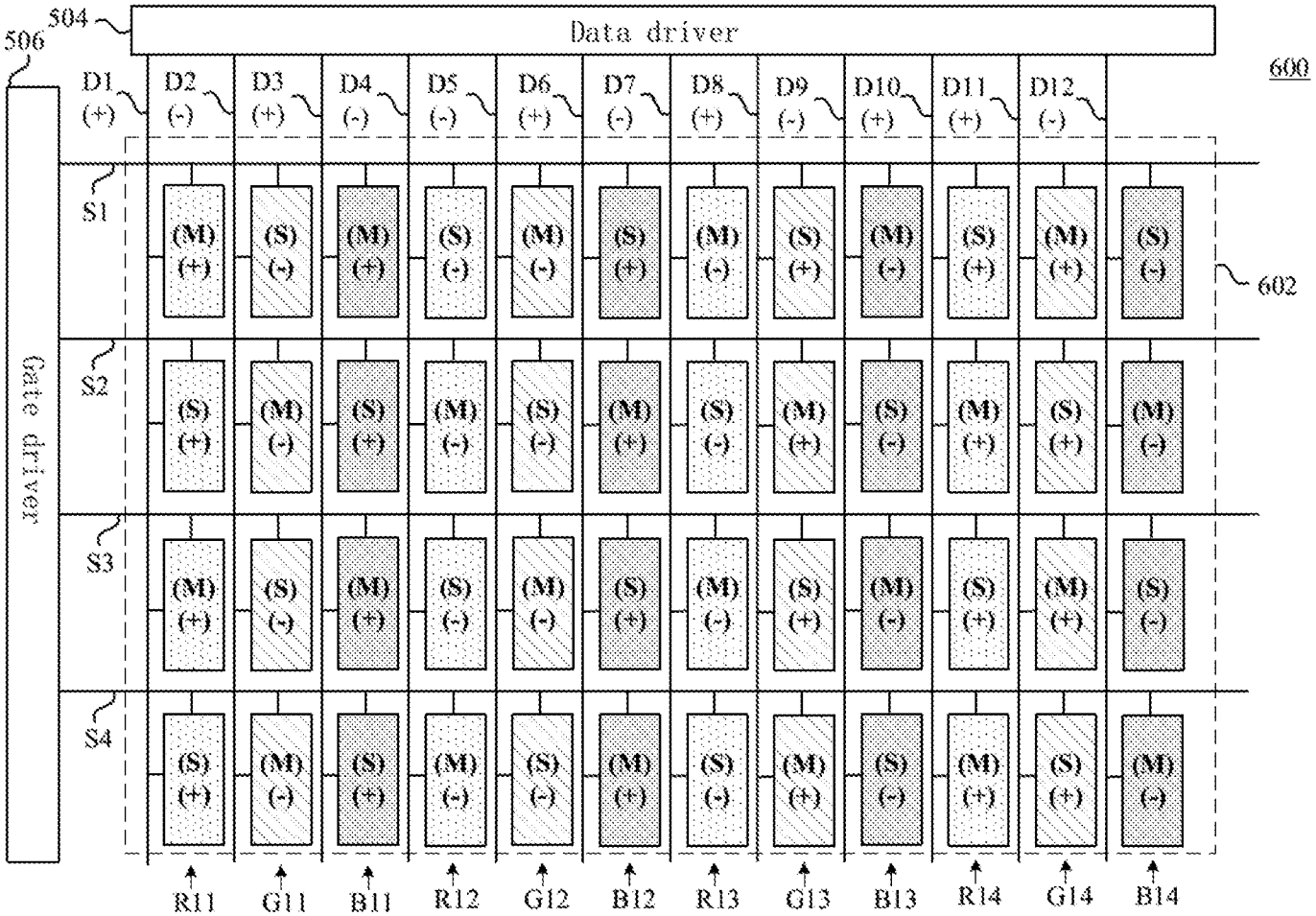
FIG. 6 is a schematic diagram of a display device according to some embodiments of the present disclosure.

FIG. 6 is a schematic diagram of a display device 600 according to some embodiments of the present disclosure. The display device 600 in FIG. 6 has a similar configuration as the display device 500 in FIG. 5. In the pixel array 602 of the display device 600, the polarities of the data lines periodically change every twelve data lines. Please refer to FIG. 6. The polarities of the data lines D1 to D12 are sequentially positive, negative, positive, negative, negative, positive, negative, positive, negative, positive, positive, and negative (which is substantially the same as the cycle in FIG. 5 except a translation of two data lines).

The pixel array 602 also adopts column inversion. That is to say, the sub-pixels electrically coupled to the same data line have the same polarity. In this way, the problem of pre-charging to the wrong polarity (resulting in bright and dark lines) due to polarity inversion may not happen.

In the configuration of the pixel array 602, the data lines on two sides of any one of the sub-pixel columns R11 and R13 have different polarities. The data lines on two sides of any one of the sub-pixel columns G11, G12, G13, and G14 have different polarities. The data lines on two sides of any one of the sub-pixel columns B11, B12, B13, and B14 have different polarities.

However, the data lines D4 and D5 on two sides of the sub-pixel column R12 (the red sub-pixel column) have the same polarity (for example, they both have the negative polarity). The data lines D10 and D11 on two sides of the sub-pixel column R14 (the red sub-pixel column) have the same polarity (for example, they both have the positive polarity).

Figure 7:
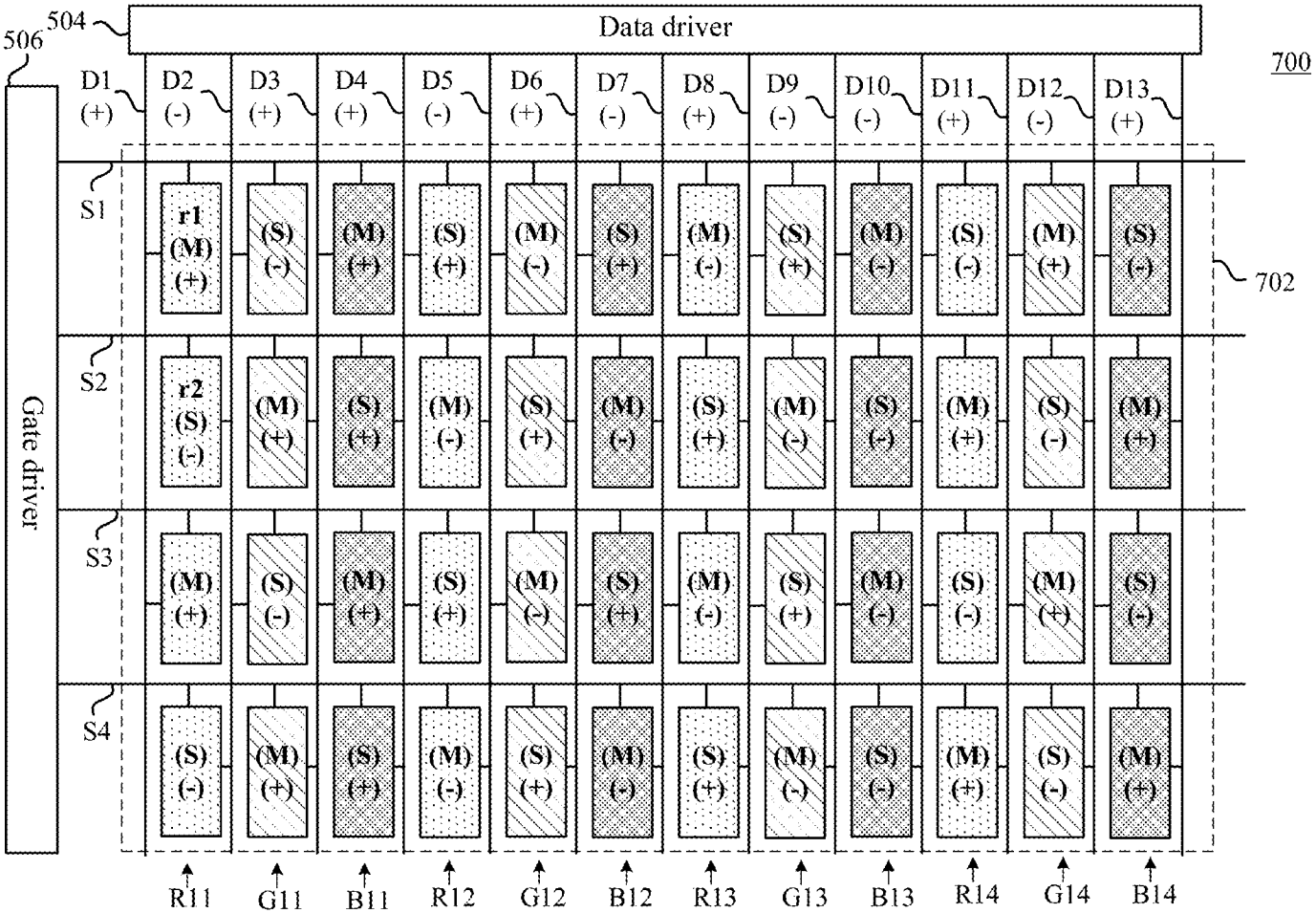
FIG. 7 is a schematic diagram of a display device according to some embodiments of the present disclosure.

FIG. 7 is a schematic diagram of a display device 700 according to some embodiments of the present disclosure. The display device 700 in FIG. 7 has a similar configuration as the display device 500 in FIG. 5. The display device 700 further includes a data line D13. In the pixel array 702 of the display device 700, the polarities of the data lines periodically change every twelve data lines. Please refer to FIG. 7. The polarities of the data lines D1 to D12 are sequentially positive, negative, positive, positive, negative, positive, negative, positive, negative, negative, positive, and negative (which is substantially the same as the cycle in FIG. 5 except a translation of three data lines).

The pixel array 702 also adopts column inversion. That is to say, the sub-pixels electrically coupled to the same data line have the same polarity. In this way, the problem of pre-charging to the wrong polarity (resulting in bright and dark lines) due to polarity inversion may not happen.

In the pixel array 702, the first to the fourth rows are electrically coupled to the scan lines S1 to S4 in sequence. The sub-pixels in the first row and the third row are electrically coupled to the data lines on the left side, and the sub-pixels in the second row and the fourth row are electrically coupled to the data lines on the right side. In other words, each of the sub-pixel columns at least includes a first sub-pixel and a second sub-pixel. The first sub-pixel and the second sub-pixel are electrically coupled to two adjacent scan lines and to two adjacent data lines respectively. Taking the sub-pixel column R11 as an example. The first sub-pixel r1 and the second sub-pixel r2 are electrically coupled to the two adjacent scan lines S1 and S2 respectively, and are also electrically coupled to the two adjacent data lines D1 and D2 respectively.

In the configuration of the pixel array 702, the data lines D3 and D4 on two sides of the sub-pixel column B11 have the same polarity (for example, they both have the positive polarity). The data lines D9 and D10 on two sides of the sub-pixel column B13 have the same polarity (for example, they both have the negative polarity). Because only the data lines on two sides of the blue sub-pixel column have the same polarity, the V-crosstalk problem only occurs in the blue sub-pixels. However, human eyes are less sensitive to the blue light and thus may not easily sense the impact of the crosstalk.

Figure 8:
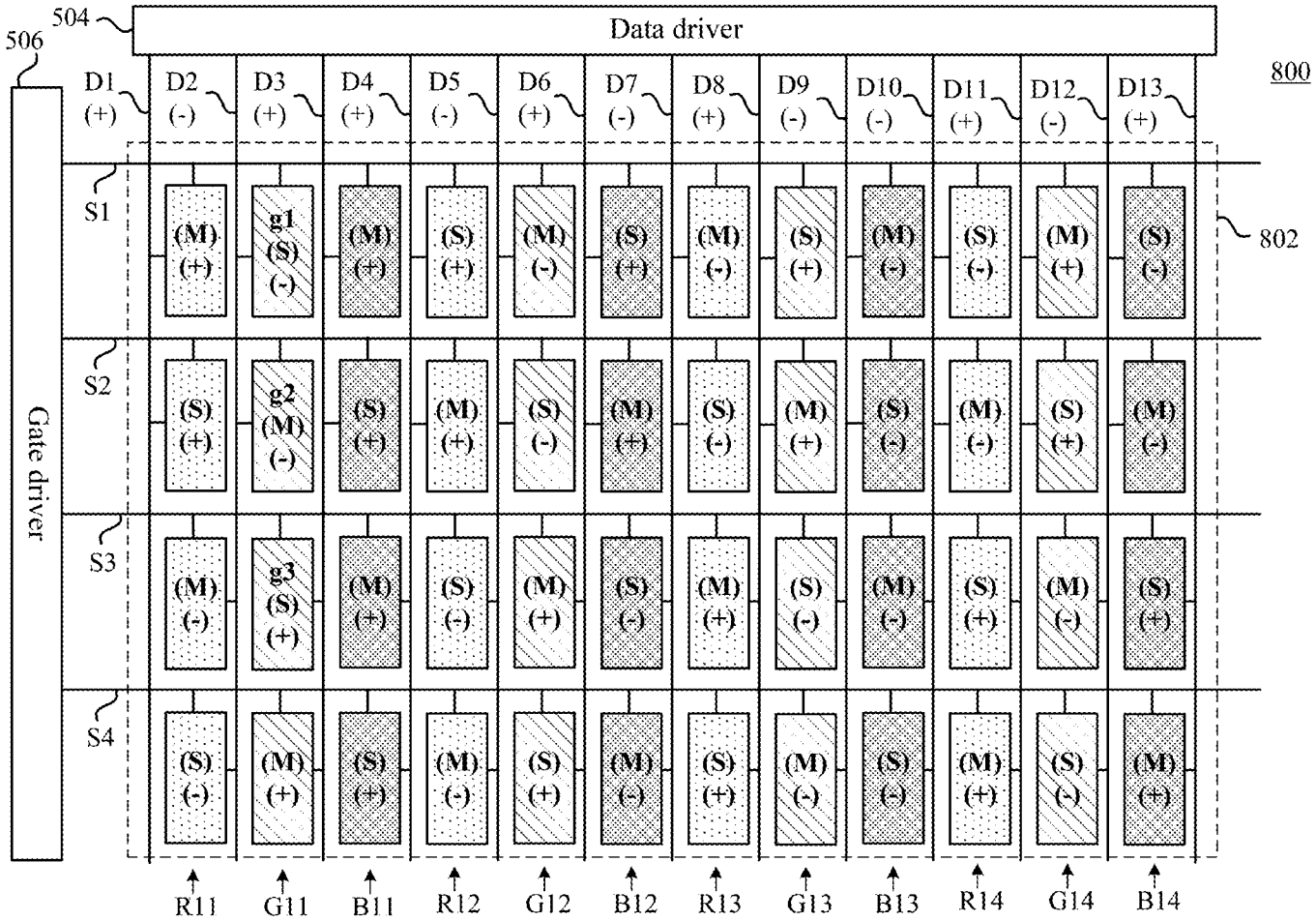
FIG. 8 is a schematic diagram of a display device according to some embodiments of the present disclosure.

FIG. 8 is a schematic diagram of a display device 800 according to some embodiments of the present disclosure. The display device 800 in FIG. 8 has a similar configuration as the display device 700 in FIG. 7. The display device 800 further includes a data line D13. Additionally, in a pixel array 802 of the display device 800, the sub-pixels in the first row and the second row are electrically coupled to the data lines on the left side, but the sub-pixels in the third row and the fourth row are electrically coupled to the data lines on the right side. In other words, each of the sub-pixel columns at least includes a first sub-pixel, a second sub-pixel, and a third sub-pixel. The first sub-pixel and the second sub-pixel are electrically coupled to two adjacent scan lines respectively and are electrically coupled to the same data line. The second sub-pixel and the third sub-pixel are electrically coupled to two adjacent scan lines and to two adjacent data lines respectively. Taking the sub-pixel column G11 as an example. The first sub-pixel g1 and the second sub-pixel g2 are electrically coupled to the data line D2 and are electrically coupled to the two adjacent scan lines S1 and S2 respectively. The second sub-pixel g2 and the third sub-pixel g3 are electrically coupled to the two adjacent scan lines S2 and S3 and to the two adjacent data lines D2 and D3 respectively.

The pixel array 802 also adopts column inversion. That is to say the sub-pixels electrically coupled to the same data line have the same polarity. In this way, the problem of pre-charging to the wrong polarity (resulting in bright and dark lines) due to polarity inversion may not happen.

In the configuration of the pixel array 802, the data lines D3 and D4 on two sides of the sub-pixel column B11 have the same polarity (for example, they both have the positive polarity). The data lines D9 and D10 on two sides of the sub-pixel column B13 have the same polarity (for example, they both have the negative polarity). Because only the data lines on two sides of the blue sub-pixel column may have the same polarity, the V-crosstalk problem only occurs in the blue sub-pixels. However, human eyes are less sensitive to the blue light and thus may not easily sense the impact of the crosstalk.

In some embodiments, a driver has an input end and at least twelve output ends. The input end of the driver is configured to receive a clock signal. The at least twelve output ends of the driver are configured to output a sequence of polarities of the corresponding output signals at one time period. The sequence of polarities of the twelve output signals are positive, negative, positive, negative, positive, negative, negative, positive, negative, positive, negative, and positive in sequence. Wherein the time period could be a line refreshing period, two line refreshing period or a frame refreshing period. The at least twelve output signals of the driver are configured to output another sequence of polarities at another time period. The another sequence of polarities at another time period are negative, positive, negative, positive, negative, positive, positive, negative, positive, negative, positive and negative.

It should be noted that the quantity of the data lines, the quantity of the scan lines, and the quantity of the sub-pixels in each of the display devices are merely exemplary, and the present disclosure is not limited thereto.

In view of the above, any one of the above embodiments can be applied to reduce the impact of bright and dark lines or crosstalk on the display quality.

Even though the present disclosure has been disclosed as the embodiments, it is not limited thereto. Any person of ordinary skill in the art may make various changes and adjustments without departing from the spirit and scope of the present disclosure. Therefore, the scope of the present disclosure is defined in view of the appended claims.

What is claimed is:

1. A display device, comprising:

a plurality of scan lines;

a pixel array, comprising a plurality of sub-pixels arranged in a first row of first-color sub-pixels, a second row of second-color sub-pixels, a third row of third-color sub-pixels, a fourth row of third-color sub-pixels, a first sub-pixel column, a second sub-pixel column, a third sub-pixel column, a forth sub-pixel column, a fifth sub-pixel column, a 6th sub-pixel column, a 7th sub-pixel column, a 8th sub-pixel column, a 9th sub-pixel column, a 10th sub-pixel column, an 11th sub-pixel column, and a 12th sub-pixel column, wherein the first row of first-color sub-pixels connects to a first scan line, and the first sub-pixel column to the 12th sub-pixel column are arranged in sequence from left to right;

a plurality of data lines, comprising twelve consecutive data lines electrically coupled to the first sub-pixel column to the 12th sub-pixel column respectively; and a data driver, coupled to the plurality of data lines to output corresponding data signals to corresponding data lines, wherein the data driver provides a sequence of polarities to the twelve data lines;

wherein the third row comprises a first sub-pixel with a first polarity, the fourth row comprises a second sub-pixel with a second polarity, both the first sub-pixel and the second sub-pixel connect to a first data line, and all the sub-pixels between the first sub-pixel and the second sub-pixel are with the first polarity;

wherein the sequence of polarities of the twelve data lines are positive, negative, positive, negative, positive, negative, negative, positive, negative, positive, negative, and positive in sequence; and wherein the first sub-pixel column, the forth sub-pixel column, the 7th sub-pixel column and the 10th sub-pixel column are in red color, the second sub-pixel column, the fifth sub-pixel column, the 8th sub-pixel column and the 11th sub-pixel column are in green color, and the third sub-pixel column, a sixth sub-pixel column, the 9th sub-pixel column and the 12th sub-pixel column are in blue color.

2. The display device according to claim 1, wherein the first sub-pixel and the second sub-pixel are blue sub-pixels.

3. The display device according to claim 1, wherein the first row comprises a plurality of main sub-pixels and a plurality of sub sub-pixels, and the main sub-pixels and sub sub-pixels are repeatedly disposed in a staggered manner.

4. The display device according to claim 1, wherein the sub-pixels in the first row has a polarity sequence for every four sub-pixels.

5. The display device according to claim 4, wherein the polarity sequence is positive, positive, negative, and negative.

6. The display device according to claim 1, wherein the sub-pixels in the first row has a polarity sequence for every eight sub-pixels.

7. The display device according to claim 6, wherein the polarity sequence is positive, negative, negative, positive, negative, positive, positive, and negative, or is positive, positive, positive, positive, negative, negative, negative, and negative.

8. A display device, comprising:

a plurality of scan lines;

a pixel array, electrically coupled to the data lines and the scan lines, the pixel array comprising:

a first column of first-color sub-pixels;

a second column of second-color sub-pixels;

a third column of third-color sub-pixels;

a first sub-pixel column;

a second sub-pixel column;

a third sub-pixel column;

a forth sub-pixel column;

a fifth sub-pixel column;

a 6th sub-pixel column;

a 7th sub-pixel column;

a 8th sub-pixel column;

a 9th sub-pixel column;

a 10th sub-pixel column;

an 11th sub-pixel column; and a 12th sub-pixel column;

wherein the data lines on two sides of the third column have a first polarity, the data lines on two sides of the first column have both the first polarity and a second polarity, the data lines on two sides of the second column have both the first polarity and the second polarity, and the first sub-pixel column to the 12th sub-pixel column are arranged in sequence from left to right;

a plurality of data lines, comprising twelve consecutive data lines electrically coupled to the first sub-pixel column to the 12th sub-pixel column respectively; and a data driver, coupled to the plurality of data lines to output corresponding data signals to corresponding data lines, wherein the data driver provides a sequence of polarities to the twelve data lines;

wherein the sequence of polarities of the twelve data lines are positive, negative, positive, negative, positive, negative, negative, positive, negative, positive, negative, and positive in sequence; and wherein the first sub-pixel column, the forth sub-pixel column, the 7th sub-pixel column and the 10th sub-pixel column are in red color, the second sub-pixel column, the fifth sub-pixel column, the 8th sub-pixel column and the 11th sub-pixel column are in green color, and the third sub-pixel column, a sixth sub-pixel column, the 9th sub-pixel column and the 12th sub-pixel column are in blue color.

9. The display device according to claim 8, wherein the third-color is blue or red.

10. The display device according to claim 8, wherein the first column comprises a plurality of main sub-pixels and a plurality of sub sub-pixels, and the main sub-pixels and the sub sub-pixels are repeatedly disposed in a staggered manner.

11. The display device according to claim 8, wherein the data lines has a polarity sequence for every twelve data lines.

12. The display device according to claim 11, wherein the polarity sequence is positive, negative, positive, negative, positive, negative, negative, positive, negative, positive, negative, and positive.

13. The display device according to claim 8, wherein the first column comprises a first sub-pixel and a second sub-pixel, and the first sub-pixel and the second sub-pixel are electrically coupled to two adjacent scan lines respectively and are electrically coupled to two adjacent data lines respectively.

14. The display device according to claim 8, wherein the first column comprises a first sub-pixel, a second sub-pixel, and a third sub-pixel, the first sub-pixel and the second sub-pixel are electrically coupled to the same data line and are electrically coupled to two adjacent scan lines respectively, and the second sub-pixel and the third sub-pixel are electrically coupled to two adjacent scan lines respectively and are electrically coupled to two adjacent data lines respectively.

15. A display device, comprising:

a plurality of sub-pixels, arranged in a first sub-pixel column, a second sub-pixel column, a third sub-pixel column, a forth sub-pixel column, a fifth sub-pixel column, a 6th sub-pixel column, a 7th sub-pixel column, a 8th sub-pixel column, a 9th sub-pixel column, a 10th sub-pixel column, an 11th sub-pixel column, and a 12th sub-pixel column, wherein the first sub-pixel column to the 12th sub-pixel column are arranged in sequence from left to right;

a plurality of data lines, comprising twelve consecutive data lines electrically coupled to the first sub-pixel column to the 12th sub-pixel column respectively; and a data driver, coupled to the plurality of data lines to output corresponding data signals to corresponding data lines, wherein the data driver provides a sequence of polarities to the twelve data lines;

wherein the sequence of polarities of the twelve data lines are positive, negative, positive, negative, positive, negative, negative, positive, negative, positive, negative, and positive in sequence; and wherein the first sub-pixel column, the forth sub-pixel column, the 7th sub-pixel column and the 10th sub-pixel column are in red color, the second sub-pixel column, the fifth sub-pixel column, the 8th sub-pixel column and the 11th sub-pixel column are in green color, and the third sub-pixel column, a sixth sub-pixel column, the 9th sub-pixel column and the 12th sub-pixel column are in blue color.

16. A display device, comprising:

a plurality of sub-pixels, arranged in a first sub-pixel column, a second sub-pixel column, a third sub-pixel column, a forth sub-pixel column, a fifth sub-pixel column, a 6th sub-pixel column, a 7th sub-pixel column, a 8th sub-pixel column, a 9th sub-pixel column, a 10th sub-pixel column, an 11th sub-pixel column, and a 12th sub-pixel column, wherein the first sub-pixel column to the 12th sub-pixel column are arranged in sequence from left to right;

a plurality of data lines, comprising twelve consecutive data lines electrically coupled to the first sub-pixel column to the 12th sub-pixel column respectively; and a data driver, coupled to the plurality of data lines to output corresponding data signals to corresponding data lines, wherein the data driver provides a sequence of polarities to the twelve data lines;

wherein the sequence of polarities of the twelve data lines are positive, negative, positive, negative, positive, negative, negative, positive, negative, positive, negative, and positive in sequence; and wherein the third sub-pixel column, the sixth sub-pixel column, the 9th sub-pixel column and the 12th sub-pixel column are in red color, the first sub-pixel column, the forth sub-pixel column, the 7th sub-pixel column and the 10th sub-pixel column are in green color, and the second sub-pixel column, the fifth sub-pixel column, the 8th sub-pixel column and the 11th sub-pixel column are in blue color.

* * * * *